US005809594A

United States Patent [19]

Isogai

[11] Patent Number: 5,809,594

[45] Date of Patent: Sep. 22, 1998

[54] COMBINATION PILLOW

[75] Inventor: Shigeaki Isogai, Tokyo-to, Japan

[73] Assignee: Lofty Kabushiki Kaisha, Tokyo, Japan

[21] Appl. No.: 911,857

[22] Filed: Aug. 15, 1997

[51] Int. Cl.[6] ..... A47G 9/00

[52] U.S. Cl. ..... 5/645; 5/644

[58] Field of Search ..... 5/636, 649, 640, 5/645

[56] References Cited

U.S. PATENT DOCUMENTS

| | | | |
|---|---|---|---|
| 4,513,462 | 4/1985 | Thomas | 5/636 X |
| 5,367,731 | 11/1994 | O'Sullivan | 5/636 X |
| 5,457,832 | 10/1995 | Tatum | 5/636 |
| 5,471,691 | 12/1995 | Ryndak | 5/636 X |
| 5,522,108 | 6/1996 | Fujiwara et al. | 5/636 X |
| 5,708,998 | 1/1998 | Terbik | 5/145 X |

*Primary Examiner*—Michael F. Trettel
*Attorney, Agent, or Firm*—Juettner Pyle Piontek & Underwood

[57] ABSTRACT

To provide a pillow by which the cervical vertebras and the occipital region of a sleeper can be supported in stable, and the head of the sleeper is prevented from accidentally coming off from the pillow even if he should toss about while sleeping.

A pair of pillow end core units are disposed at both cross directional ends of a pillow case 12 so as to form right angles to a cross direction of the pillow case 12. Between the pair of pillow end core units, a cervical vertebra support pillow core unit 20 and a first occipital region support pillow core unit 22 are disposed along the cross direction of the pillow case 12. Further, between the cervical vertebra support pillow core unit 20 and the first occipital region support pillow core unit 22, a second occipital region support pillow core unit 24 is disposed. The pillow 10 is configured so that the height H1 of the pillow end core units is highest, the height H2 of the cervical vertebra support pillow core unit 20 and the first occipital region support pillow core unit 22 is second-highest, and the height H3 of the second occipital region support pillow core unit 24 is lowest.

9 Claims, 4 Drawing Sheets

COMBINATION PILLOW

FIELD OF THE INVENTION

The present invention relates to a combination pillow wherein a core unit thereof is contained in a pillow case, providing support to cervical vertebrae and an occipital region and preventing a head from easily rolling off the pillow.

BACKGROUND OF THE INVENTION

As shown in FIG. 4, many of conventional pillows 1 have a construction in which an appropriate filling material 3 such as a buckwheat husk, sponge, feather, plastic ball, plastic pipe, or the like is filled.

However, a pillow 1 of this type has a construction in which the mentioned filling material is simply filled, accordingly, no member is provided to specifically support cervical vertebrae and an occipital region.

In addition, as the pillow 1 of this type is merely filled with the filling material 3 so that the pillow case 2 is simply bulged therewith, there is a disadvantage in that a head may easily roll off the pillow when a person tosses about as no member is provided to oppose such a rolling off.

In view of the aforementioned disadvantages, it is an object of the present invention to provide a combination pillow which can support cervical vertebras and an occipital region of a sleeper and prevent the head from easily coming off the pillow when a person makes a tossing about or the like while sleeping.

SUMMARY OF THE INVENTION

The invention stated in claim 1 provides a combination pillow comprising two pillow end core units which are disposed at both cross directional ends of a pillow case so as to form right angles to a cross direction of the pillow case, a cervical vertebra support pillow core unit which is disposed between the pillow end core units along the cross direction of the pillow case, a first occipital region support pillow core unit which is disposed between the pillow end core units along the cross direction of the pillow case, and a second occipital region support pillow core unit which is disposed between the pillow end core units in the cross direction of the pillow case and which is also disposed between the cervical vertebra support pillow core unit and the first occipital region support pillow core unit, wherein the height of the pillow end core units is made lower than both the height of the cervical vertebra support pillow core unit and the height of the first occipital region support pillow core unit, and the height of the second occipital region support pillow core unit is made lower than both the height of the cervical vertebra support pillow core unit and the height of the first occipital region support pillow core unit.

DETAILED DESCRIPTION

Figure 1:
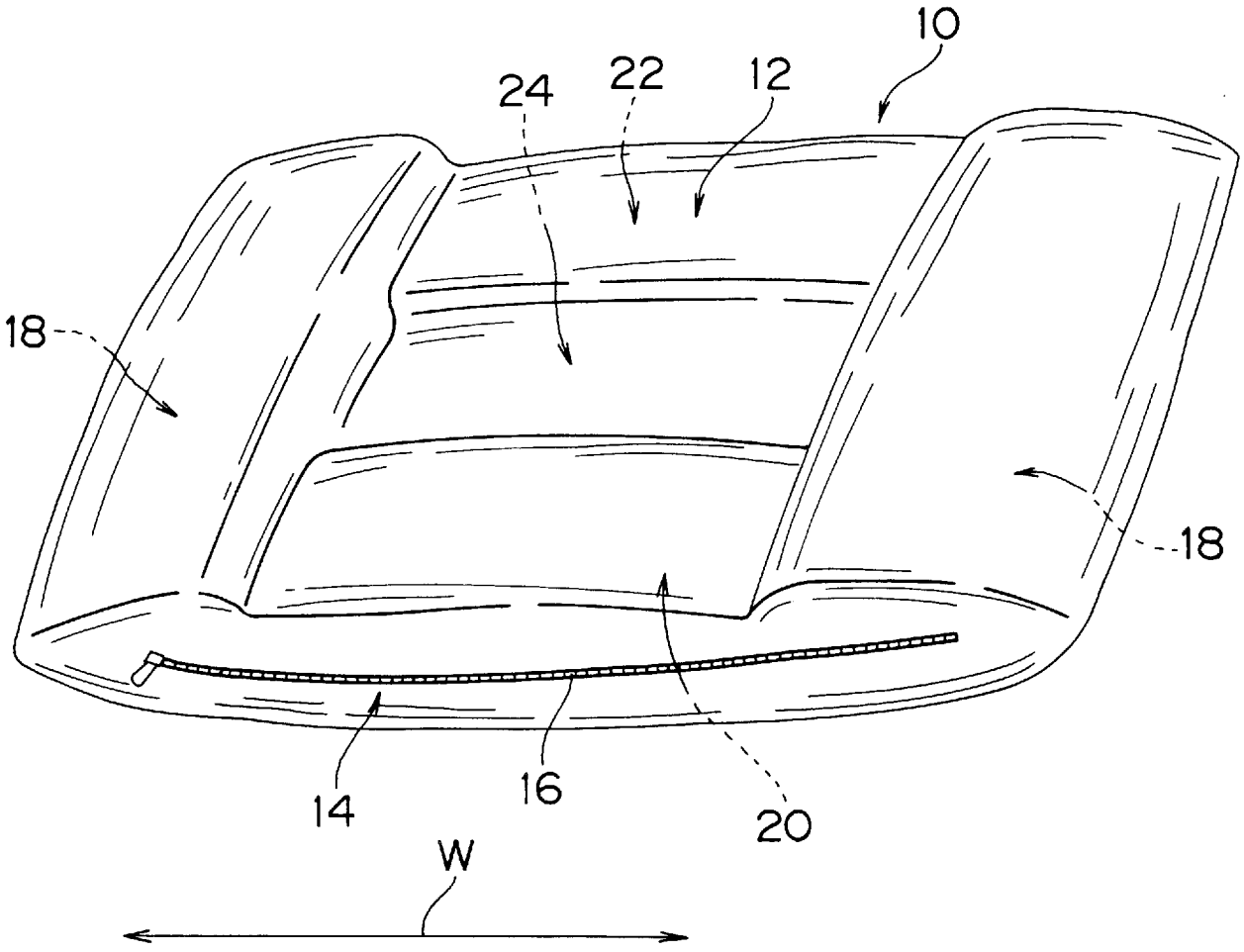
FIG. 1 is an entire perspective view of a combination pillow according to the present invention.
Figure 2:
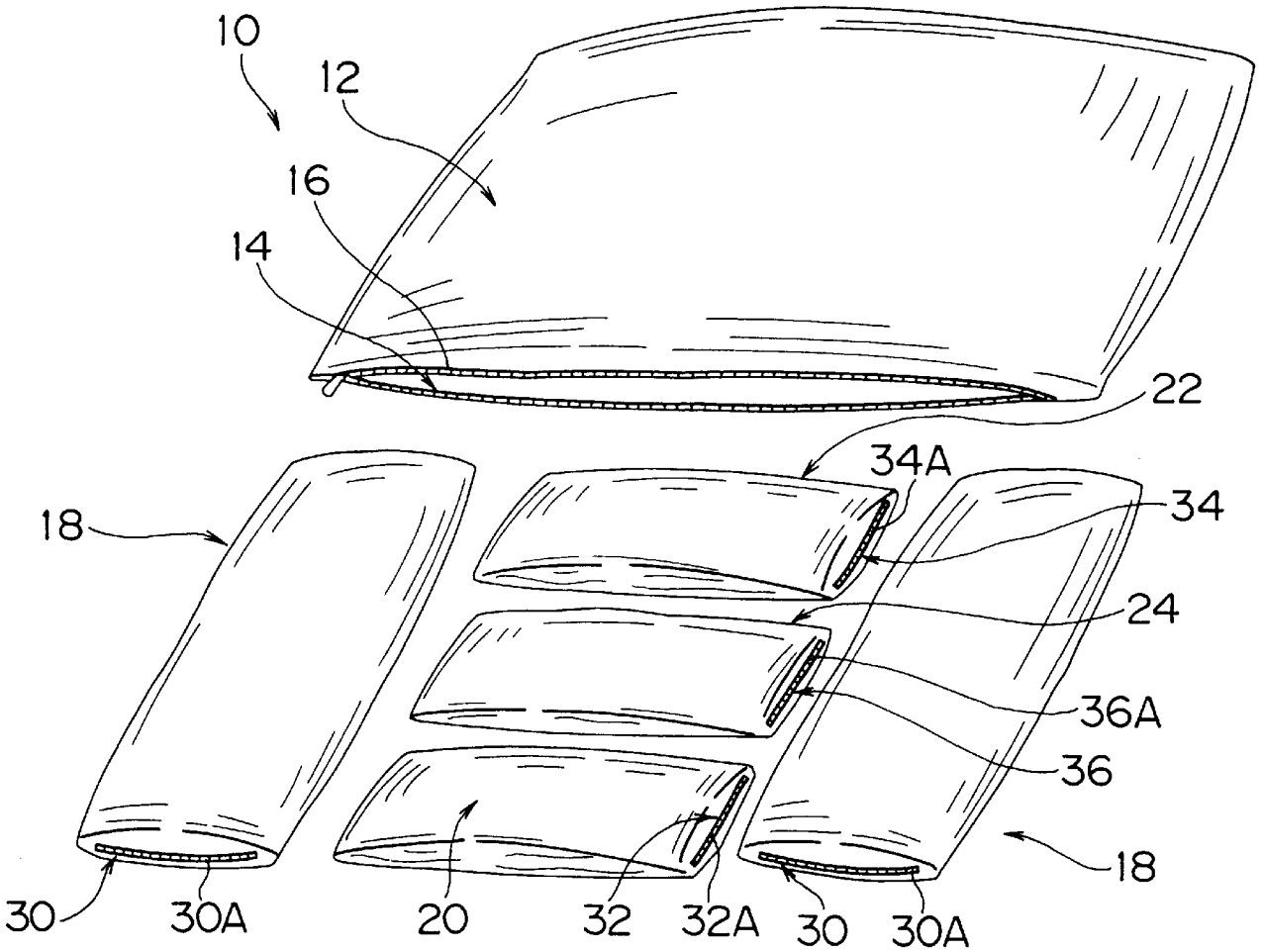
FIG. 2 is an entire perspective diagram of the combination pillow of FIG. 1 with the pillow end core units, the cervical vertebra support pillow core unit, the first occipital region support pillow core unit and the second occipital region support pillow core unit are taken out from the pillow case.
Figure 3:
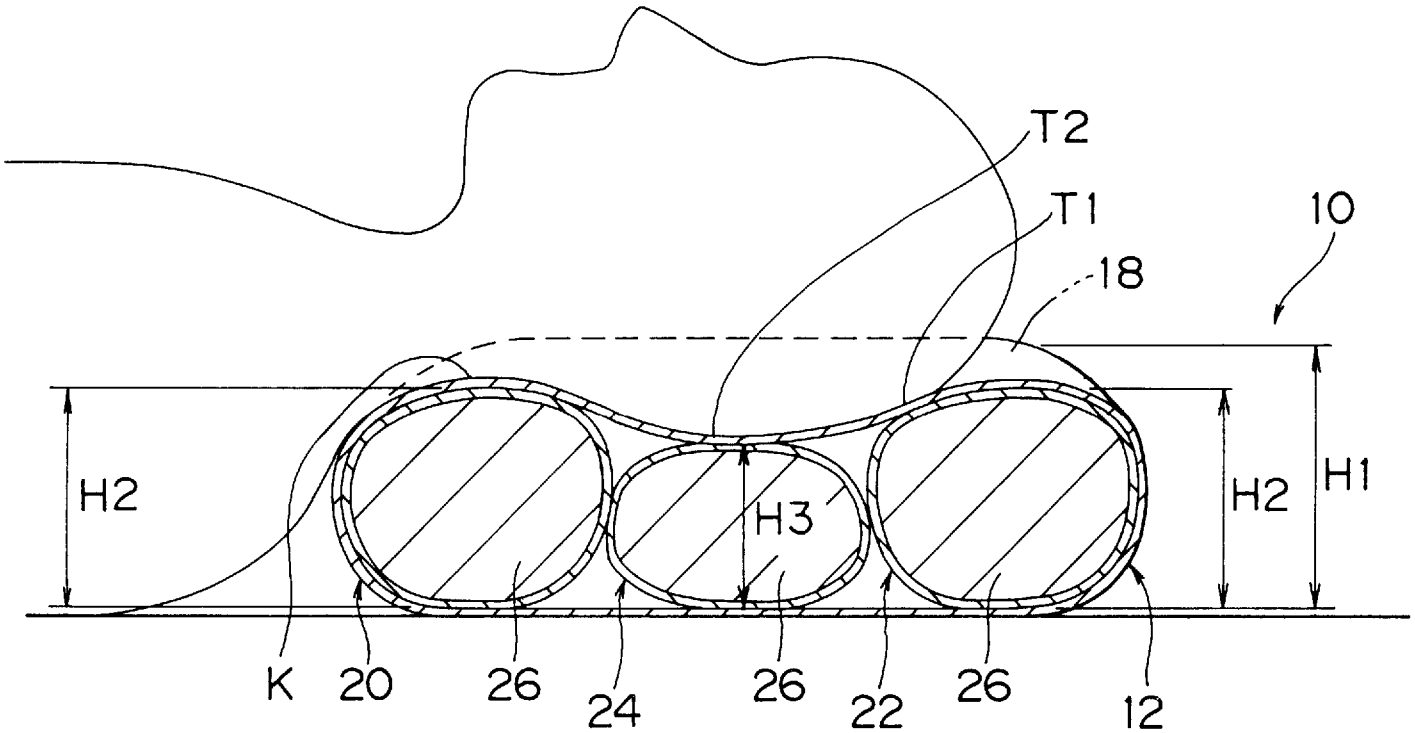
FIG. 3 is a partial longitudinal sectional view of the combination pillow.
Figure 4:
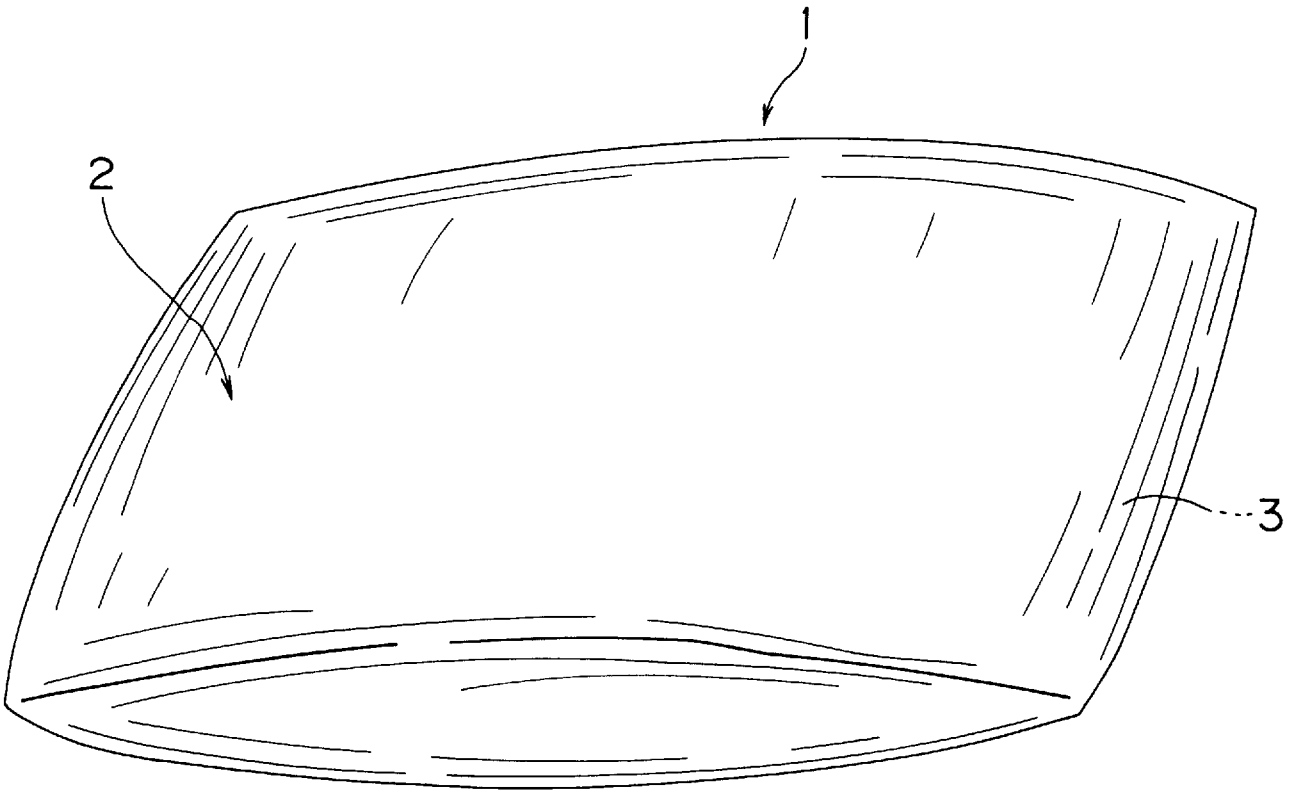
FIG. 4 is an entire perspective view of a conventional pillow.

FIG. 1 to FIG. 3 show one embodiment of a combination pillow according to the present invention by way of example. As shown in FIG. 1 and FIG. 2, a bag-like pillow case 12 of a combination pillow 1 has an opening 14 to which a zipper 16 is attached.

At both cross directional ends (in the direction of arrow W in FIG. 1) of the pillow case 12, pillow end core units 18 are disposed so as to form right angles to a cross direction of the pillow case 12.

Between the two pillow end core units 18, a cervical vertebra support pillow core unit 20 is disposed along the cross direction of the pillow case 12. Further, between the two pillow end core units 18, there is also disposed a first occipital region support pillow core unit 22 so as to be spaced from the cervical vertebra support pillow core unit 20.

More further, between the two pillow end core units 18 and also between the cervical vertebra support pillow core unit 20 and the first occipital region support pillow core unit 22, a second occipital region support pillow core unit 24 is disposed.

The pillow end core units 18, the cervical vertebra support pillow core unit 20, the first occipital region support pillow core unit 22, and the second occipital region support pillow core unit 24 are all filled with plastic balls 26 made of plastic as a filling material (in FIG. 3, the plastic balls 26 filled in the cervical vertebra support pillow core unit 20, the first occipital region support pillow core unit 22, and the second occipital region support pillow core unit 24 are indicated by oblique lines).

Furthermore, as shown in FIG. 3, the pillow 10 is configured so that the height H1 of the pillow end core units 18 is highest, the height H2 of the cervical vertebra support pillow core unit 20 and the first occipital region support pillow core unit 22 is second-highest, and the height H3 of the second occipital region support pillow core unit 24 is lowest.

Besides, as shown in FIG. 2, each of the pillow end core units 18 is provided with an opening 30 to which a zipper 30A is attached. The cervical vertebra support pillow core unit 20 is provided with an opening 32 to which a zipper 32A is attached. The first occipital region support pillow core unit 22 is provided with an opening 34 to which a zipper 34A is attached. The second occipital region support pillow core unit 24 is provided with an opening 36 to which a zipper 36A is attached.

Therefore, the plastic balls 26 can be freely put in and out from the pillow end core units 18 through the opening 30, the cervical vertebra support pillow core unit 20 through the opening 32, the first occipital region support pillow core unit 22 through the opening 34, and the second occipital region support pillow core unit 24 through the opening 36.

The operation of the embodiment mentioned above will be described below.

When a person sleeps using the combination pillow 10 according to the present invention, the person sleeps so that the cervical vertebras K correspond to the cervical vertebra support pillow core unit 20, a top of the occipital region T1 to the first occipital region support pillow core unit 22, and a middle of the occipital region T2 to the second occipital region support pillow core unit 24. Therefore, the cervical vertebras K are supported by the cervical vertebra support pillow core unit 20, the top of the occipital region T1 is supported by the first occipital region support pillow core unit 22, and the slightly projected middle part of the occipital region T2 is supported by the second occipital region support pillow core unit 24 which is most recessed, therefore, the person can sleep quietly with the cervical vertebras K and the top and middle of the occipital region T1, T2 being supported by the cervical vertebra support pillow core unit 20.

Furthermore, the pillow end core units 18 which are higher than the first occipital region support pillow core unit 22 and the second occipital region support pillow core unit 24 are disposed at both ends of the combination pillow, so that if the person tosses about while sleeping, his head will be prevented from easily rolling off of the combination pillow by the pillow end core units 18.

Still further, the plastic balls 26 used as filling material material are filled separately into the pillow end core units 18, the cervical vertebra support pillow core unit 20, the first occipital region support pillow core unit 22, and the second occipital region support pillow core unit 24, therefore, the plastic balls 26 filled in the pillow end core units 18 can move only therein, the plastic balls 26 filled in the cervical vertebra support pillow core unit 20 can move only therein, the plastic balls 26 filled in the first occipital region support pillow core unit 22 can move only therein, and the plastic balls filled in the second occipital region support pillow core unit 24 can move only therein. Consequently, awkward deformation of the combination pillow 10 due to excessive movement of the plastic balls 26 can be prevented.

In the preferred embodiment described above, each of the two pillow end core units 18 is also provided with an opening 30, the cervical vertebra support pillow core unit 20 with an opening 32, the first occipital region support pillow core unit 22 with an opening 34, and the second occipital region support pillow core unit 24 with an opening 36, respectively.

Further, in the embodiment mentioned above, plastic balls 26 are used as filling material. It is understood, however, that many other filling materials may be used, including, but not restricted to, plastic pipes, buckwheat husks, feathers, or down.

As mentioned above, the combination pillow according to the present invention provides outstanding advantages in that the cervical vertebras are supported by the cervical vertebra support pillow core unit, and the occipital region is supported by the first and second occipital region support pillow core units in stable, and that the pillow end core units prevent the head of the sleeper from accidentally coming off from the combination pillow even if the sleeper tosses about.

What is claimed is:

1. A combination pillow comprising:

a) a substantially rectangular pillow case, said pillow case having an interior, said interior having a transverse direction with two opposing transverse ends, having first and second transverse sides, and having a center region;

b) a pair of pillow end core units, each of said end core units disposed at a respective transverse end of said pillow case, said end core units oriented generally perpendicular to said transverse direction;

c) a cervical vertebrae support pillow core unit, said vertebrae core unit disposed between said end core units, said vertebrae support core unit oriented generally parallel to said transverse direction and disposed along said first transverse side;

d) a first occipital region support pillow core unit disposed between said end core units, oriented generally parallel to said transverse direction and disposed along said second transverse side;

e) a second occipital region support pillow unit disposed between said end core units, oriented generally parallel to said transverse direction and disposed near said interior center region; and f) said end core units each having a height that is greater than the height of said vertebrae support core unit and also greater than the height of said first and said second occipital region support core units, said vertebrae support core unit having a height which is approximately equal to that of said first occipital region support core unit, and said second occipital region support core unit having a height less than the height of said vertebrae support core unit.

2. A combination pillow as in claim 1, wherein said second occipital region support core unit has a substantially level upper surface and a substantially level lower surface.

3. A combination pillow as in claim 1, wherein said end core units are substantially cylindrical.

4. A combination pillow as in claim 1, wherein each of said core units comprises a sealable enclosure filled with a material chosen from the group consisting of synthetic fiber, feathers, down, plastic balls, wood particles, buckwheat husks, or foam.

5. A combination pillow as in claim 1, wherein each of said core units is comprised of foam.

6. A combination pillow comprising:

a) a substantially rectangular pillow case, said pillow case having an interior, said interior having a transverse direction with two opposing transverse ends, having first and second transverse sides, and having a center region;

b) a pair of pillow end core units, each of said end core units disposed at a respective transverse end, said end core units oriented generally perpendicular to said transverse direction;

c) a cervical vertebrae support core unit, said vertebrae core unit disposed between said end core units, said vertebrae support core unit oriented generally parallel to said transverse direction disposed along said first transverse side;

d) a first occipital region support pillow core unit disposed between said end core units, oriented generally parallel to said transverse direction and disposed along said second transverse side;

e) a second occipital region support pillow unit disposed between said end core units, oriented generally parallel to said transverse direction and disposed near said interior center region; and f) said end core units, said vertebrae support core units, said first and second occipital support core units each being separate, removable from said pillow case, and independent from one another, and each said core unit comprising a sealable enclosure filled with a material selected from the group consisting of wood particles, plastic spheres, feathers, foam, buckwheat husks, or synthetic fibers.

7. A combination pillow as in claim 6, wherein said second occipital region support core unit has a substantially level upper surface and a substantially level lower surface.

8. A combination pillow as in claim 6, wherein said end core units are substantially cylindrical.

9. A combination pillow, comprising:

a) a substantially rectangular pillow case, said pillow case having an interior, b) a pair of substantially cylindrical end core units in said interior, c) a cervical vertebrae support core unit in said interior;

d) a first occipital region support core unit in said interior;

e) a second occipital region support core unit in said interior and having a substantially level upper and lower surface;

f) said end core units each having a height that is greater than the height of said vertebrae support core unit and also greater than the height of said first and said second occipital region support core units, and said vertebrae support core unit having a height which is approximately equal to that of said first occipital region support core unit, and said second occipital region support core unit having a height less than the height of said vertebrae support core unit; and g) said end core units, said vertebrae support core units, said first and second occipital support core units each being separate, removable from said pillow case, and independent from one another, and each comprising a sealable enclosure filled with a material selected from the group consisting of wood particles, plastic spheres, feathers, foam, buckwheat husks, or synthetic fibers, whereby said core units may be arranged within said pillow case as desired.

* * * * *